United States Patent [19]

Bergner et al.

[11] Patent Number: 4,653,248

[45] Date of Patent: Mar. 31, 1987

[54] APPARATUS FOR MAKING CARTONS OF CIGARETTE PACKS AND THE LIKE

[75] Inventors: Herbert Bergner, Reinbek; Otto Blidung, Geesthacht; Johannes Harten, Büchen, all of Fed. Rep. of Germany

[73] Assignee: Hauni-Werke Körber & Co. KG., Hamburg, Fed. Rep. of Germany

[21] Appl. No.: 794,099

[22] Filed: Nov. 1, 1985

[30] Foreign Application Priority Data

Nov. 10, 1984 [DE] Fed. Rep. of Germany ..... 3441234

[51] Int. Cl.[4] ..... B65B 11/28

[52] U.S. Cl. ..... 53/231; 53/252; 53/253

[58] Field of Search ..... 53/252, 251, 250, 253, 53/228, 230, 231, 148, 207

[56] References Cited

U.S. PATENT DOCUMENTS

| | | | |
|---|---|---|---|
| 2,917,887 | 12/1959 | Jackson | 53/230 |
| 3,125,841 | 3/1964 | Anderson | 53/228 |
| 3,910,012 | 10/1975 | Schmermund | 53/253 X |
| 3,948,115 | 4/1976 | Seragnoli | 53/148 X |
| 4,095,396 | 6/1978 | Seragnoli | 53/148 X |
| 4,367,618 | 1/1983 | Focke | 53/148 |
| 4,523,422 | 6/1985 | Ilsemann | 53/253 X |

FOREIGN PATENT DOCUMENTS 493351 10/1938 United Kingdom .

*Primary Examiner*—James E. Coan

*Attorney, Agent, or Firm*—Peter K. Kontler

[57] ABSTRACT

Apparatus for making cartons with arrays of cigarette packs therein has a conveyor which transports the arrays to a transfer station and a feeding unit which delivers successive blanks to the transfer station so that a freshly delivered blank is adjacent to one side of the foremost array on the conveyor. A tubular deforming member is pivotable about a horizontal axis between a first position in which an inlet of its chamber is adjacent to the transfer station so that a plunger can be caused to transfer the foremost array into the deforming member with simultaneous partial draping of the adjacent blank around the transferred array, and a second position in which the inlet is located at a level below an outlet of the deforming member. A pusher is thereupon caused to enter the deforming member by way of the inlet and to move the array and the deformed blank upwardly into a receiving unit with attendant further deformation of the blank. The blanks can also be deformed during travel of the inlet along a stationary folding device while the deforming member pivots between the first and second positions, as well as by the pusher while the latter is in the process of entering the inlet of the deforming member.

20 Claims, 5 Drawing Figures

APPARATUS FOR MAKING CARTONS OF CIGARETTE PACKS AND THE LIKE

BACKGROUND OF THE INVENTION

The present invention relates to improvements in apparatus for wrapping discrete commodities in prefabricated blanks which are converted into envelopes that surround the confined commodities. The apparatus of the present invention can be utilized with advantage for the making of cartons which contain arrays of cigarette packs or packs containing other types of smokers' products.

It is customary to confine arrays of cigarette packs in prefabricated blanks to form so-called cartons or bundles each of which normally contains ten packs of twenty rod-shaped articles each. As a rule, or at least in the United States, the packs in a carton form two superimposed layers of five packs each, and each pack of one layer overlies exactly the adjacent pack of the other layer.

In accordance with a presently known proposal, the making of cartons which contain arrays of cigarette packs involves the accumulation of a series of arrays of packs and the transport of successive arrays along a straight path wherein a discrete blank is draped around each array. The blanks can be placed onto or in front of successive arrays prior to admission of such arrays into the path. Reference may be had to U.S. Pat. No. 2,917,887. The patented apparatus comprises folding instrumentalities which serve to fold or flex the flaps and/or tucks at the sides and/or at the front and/or rear end of the advancing blank. The advancement of blanks and associated arrays along the straight path is interrupted in response to each interruption of delivery of arrays so that the adhesive which is applied to selected portions of each blank in order to bond the overlapping parts of a folded blank to each other is allowed to dry and cannot bond when the transport of the blank along the path is resumed. Thus, the patented apparatus operates satisfactorily only as long as all components of successive cartons are delivered at the anticipated rate and at anticipated intervals but it turns out a substantial number of rejects as soon as the delivery of one or more components is interrupted.

A modified carton making and filling apparatus is disclosed in U.S. Pat. No. 3,125,841. This apparatus also employs means for treating blanks during transport along a straight path. Successive arrays are introduced into a hollow folding mandrel, and a blank of wrapping material is thereupon draped around the mandrel to resemble a U-shaped body prior to introduction of the respective array into the aforementioned straight path wherein the projecting portions of the U-shaped body are folded to complete the conversion of such body into an envelope which completely surrounds the respective array. A drawback of the just described apparatus is that it must employ several pasters to apply layers of adhesive to selected portions of successive blanks in predetermined portions of the path along which the arrays and the originally U-shaped bodies are transported in the course of the carton-forming operation. Another drawback of the just described apparatus is that it can only process certain types of blanks. Thus, the apparatus is incapable of making so-called Europa-cartons except by undertaking a number of substantial and expensive alterations.

Austrian Pat. No. 248,341 discloses a further carton making and filling apparatus which employs an indexible folding turret with several folding chambers. A fresh blank is inserted into an empty chamber of the turret so that it is converted into a U-shaped body before the turret is indexed to place the inserted U-shaped body into register with an array of cigarette packs which are thereupon inserted into the turret. The turret is indexed again, and the protruding parts of the U-shaped body are folded while the respective chamber of the turret advances to an ejecting station. The turret contains an internally mounted ejector in the form of a plunger which expels the finished carton by way of the inlet of the respective chamber, i.e., counter to the direction of introduction of the respective array. The apparatus of the Austrian patent exhibits the drawback that its space requirements are excessive and also that the placing of an ejector into the interior of the turret contributes to complexity, initial and maintenance cost of the apparatus. Moreover, the apparatus must be equipped with specially designed rams or like holding devices which prevent unfolding of the flaps and tucks prior to and during expulsion of a finished carton at the ejecting station. The likelihood of opening of folded-over flaps and tucks is especially pronounced at that side of the finished carton which is located at the open end of the respective chamber.

OBJECTS AND SUMMARY OF THE INVENTION

An object of the invention is to provide a versatile apparatus which can process different types of blanks with the same degree of reproducibility.

Another object of the invention is to provide an apparatus which can turn out large numbers of cigarette cartons or the like per unit of time.

A further object of the invention is to provide an apparatus which requires a single paster and ensures reliable retention of folded-over portions of blanks in the desired positions.

An additional object of the invention is to provide an apparatus which is not only compact, simple and relatively inexpensive but is also capable of processing larger numbers of commodities and blanks per unit of time than heretofore known apparatus.

Still another object of the invention is to provide novel and improved means for deforming blanks in an apparatus of the above outlined character.

A further object of the invention is to provide the apparatus with novel and improved means for delivering arrays of cigarette packs or the like and blanks to a transfer station where the blanks are brought into contact with arrays preparatory to their conversion into the envelopes or cartons.

Another object of the invention is to provide a novel and improved method of manipulating arrays of cigarette packs or the like and blanks in a carton making apparatus.

An additional object of the invention is to provide the apparatus with novel and improved means for changing the orientation of commodities during draping of the blanks therearound.

Another object of the invention is to provide the apparatus with novel and improved means for manipulating the converted blanks upon completion of the deforming operations.

The invention is embodied in an apparatus for wrapping foldable sheet- or plate-like blanks around successive commodities, particularly for wrapping successive arrays of cigarette packs or packs containing other smokers' products into blanks which are converted into so-called cartons. As a rule, or in many instances, a carton will contain a commodity consisting of ten cigarette packs in two registering layers of five packs each. The apparatus comprises means (e.g., including a belt conveyor which receives cigarette packs from a packing machine such as that manufactured by the assignee of the present application) for conveying successive commodities along a predetermined path (e.g., along a horizontal path wherein each array of ten cigarette packs is moved longitudinally), a hollow deforming member which has an inlet and an outlet opposite the inlet and defines a chamber communicating with the inlet and the outlet and being dimensioned to accommodate one commodity at a time, means for moving the deforming member between first and second positions in which the inlet is respectively adjacent to and remote from a predetermined portion of the path for the commodities, a magazine or another suitable source of blanks (the magazine can contain a supply of parallel blanks in such orientation that the entire supply tends to slide downwardly along a suitably inclined ramp toward a position in which the foremost blank of the supply is ready for removal from the magazine), means (e.g., a mobile suction cup or a set of two or more suction cups plus one or more pairs of advancing rollers) for feeding successive blanks from the source to a predetermined position between a commodity in the predetermined portion of the path and the inlet in the first position of the deforming member, means (e.g., including a reciprocable plunger) for transferring successive commodities from the predetermined portion of the path into the deforming member by way of the inlet in the first position of the deforming member with attendant partial draping of the blank which was held in the predetermined position so that the blank surrounds a portion of the transferred commodity, and means for expelling successive commodities and the respective blanks from the deforming member by way of the outlet in the second position of the deforming member. The expelling means includes a pusher which enters the deforming member by way of the inlet.

The moving means preferably comprises means for pivoting the deforming member about a substantially horizontal axis in such a way that the inlet moves along an arcuate path which is located in a substantially vertical plane. The axis is preferably nearer to the outlet than to the inlet and is remote from the deforming member so that the outlet also advances along an arcuate path in response to movement of the deforming member from the first to the second position or vice versa.

The transferring means preferably comprises means (such as the aforementioned reciprocable plunger) for advancing successive commodities in a first direction (preferably along a substantially horizontal path), and the pusher of the exeplling means is preferably arranged to advance successive commodities in a second direction (preferably upwardly and along a substantially vertical path) which extends transversely of the first direction.

The apparatus preferably further comprises means for receiving successive commodities and the respective blanks which are expelled from the deforming member by way of the outlet in the second position of the deforming member. The receiving means is preferably located above the outlet of the deforming member when the latter assumes its second position because, and as already explained above, the construction of the improved apparatus is preferably such that the inlet is located at the level of the outlet in the first position of the deforming member but the inlet is located at a level below the outlet when the deforming member assumes its second position. In accordance with a presently preferred embodiment of the improved apparatus, the deforming member is pivoted back and forth through angles of substantially 90 degrees, and the pusher is designed to move successive commodities and the respective (at least partially draped) blanks substantially vertically upwardly in successive second positions of the deforming member.

The blanks which are partially draped around the respective commodities during transfer of such commodities into the chamber of the deforming member normally include portions in the form of tabs or flaps which extend or project from the inlet, and the apparatus preferably further comprises means for folding at least some of these projecting portions of the blanks during movement of the inlet along its arcuate path. The folding means can include a stationary folding device which is adjacent to the arcuate path of movement of the inlet. Such folding device is preferably designed to block the inlet during movement of the deforming member between the first and second positions; this prevents an inserted commodity and the respective blank from changing its position relative to the deforming member (save for the folding of the aforementioned projecting portion or portions of the blank) while the inlet moves from the position of registry with the transferring means to the position of registry with the pusher of the expelling means.

The deforming member preferably comprises a substantially tubular housing which defines the aforementioned chamber and is preferably further formed with a slot extending at right angles to the pivot axis for the deforming member. The expelling means preferably further comprises means for reciprocating the pusher between an extended position in which the pusher is located in the chamber in the region of the outlet and a retracted position outside of the housing. The aforementioned reciprocating means extends through the slot of the housing in the second position of the deforming member while the pusher is located in the chamber, regardless of the momentary angular position of the deforming member, so that the pusher can dwell in the extended position or can move from the extended toward the retracted position while the deforming member moves from its second toward its first position.

The apparatus preferably further comprises means for closing the outlet of the deforming member when the latter assumes its first position. Such closing means can include a block or an otherwise configurated stationary obstruction adjacent to that portion of the arcuate path for the outlet which is occupied by the outlet at least in the first position but not in the second position of the deforming member. The obstruction arrests the forward progress of a commodity and of the respective partially draped blank in response to a forward stroke of the transferring means but is out of the way in the second position of the deforming member so that the pusher can expel a commodity and the respective blank into the receiving means.

The blanks which issue from the deforming member or which are in the process of being expelled from the deforming member can have portions (e.g., one or more flaps or tabs) which project from the respective commodities, and the receiving means can include means for folding such projecting portions of the blanks during expulsion of the respective commodities and of the associated blanks from the chamber of the deforming member. Such folding means can comprise one or more stationary folding elements in the form of wedges, cams or the like capable of automatically folding the projecting portion or portions of a blank in response to movement of such projecting portion or portions of a blank during expulsion of the respective commodity from the chamber.

The apparatus preferably further comprises means for transporting successive commodities and the respective blanks away from the receiving means; such transporting means can comprise a reciprocating pusher or a like motion transmitting device which cooperates with a tunnel to advance successive commodities (which by then are draped into the respective blanks) along a further path which can lead to a machine wherein sets of cartons are introduced into boxes or analogous containers. Such apparatus preferably further comprises means (e.g., one or more electric resistance heaters) for heating selected portions of successive blanks in the receiving means and/or in the transporting means. Heating is desirable and often necessary if selected portions (e.g., flaps, panels and/or tabs) of the blanks are coated with layers of adhesive which is supposed to bond the overlapping portions of the blanks to each other. The heating means promotes the setting of such adhesive layers and reduces the likelihood of opening up of cartons upon advancement of the cartons beyond the tunnel of the transporting means.

Certain blanks can be configurated in such a way that portions thereof continue to extend from the inlet of the deforming member when the latter reaches its second position. The pusher is then preferably provided with means for folding such projecting portions of the blanks as a result of its movement relative to the deforming member.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
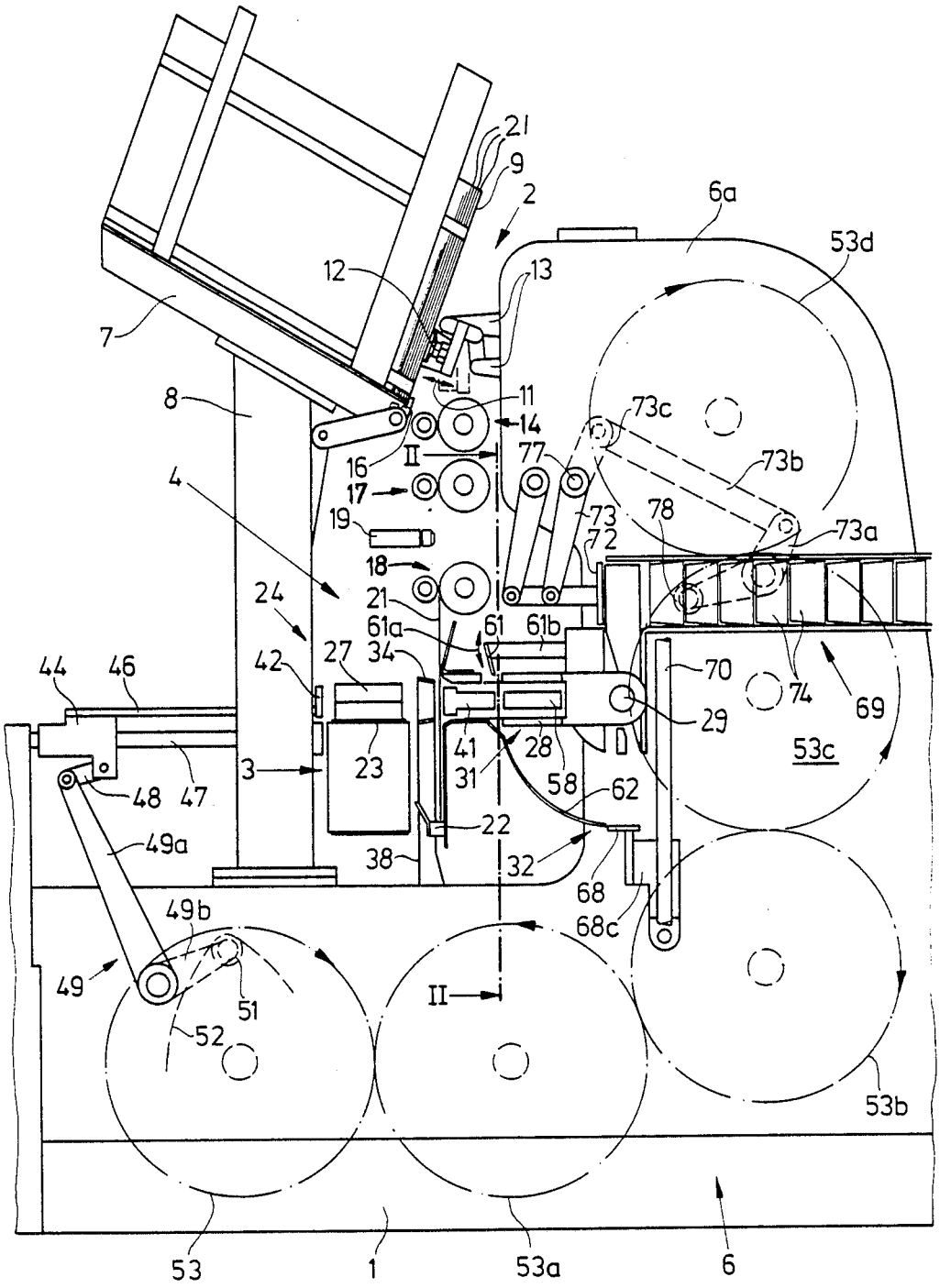
FIG. 1 is a schematic elevational view of an apparatus which embodies one form of the invention, the deforming member being shown in its first position.
Figure 2:
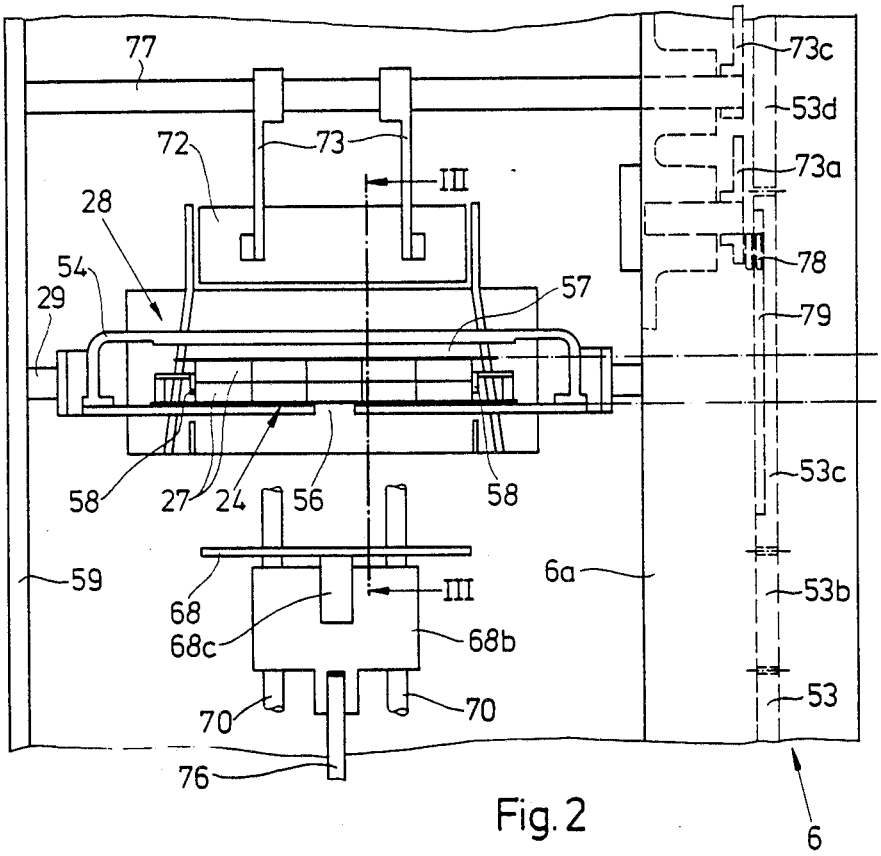
FIG. 2 is a slightly enlarged front elevational view of the deforming member and of certain adjacent parts, as seen in the direction of arrows from the line II—II in FIG. 1.

Referring first to FIGS. 1 and 2, there is shown an apparatus which is designed to make cartons 74 each of which contains an elongated block-shaped commodity 24 consisting of an array of ten cigarette packs 27 and an envelope constituting a converted blank 21 made of paper, cardboard or other suitable sheet-like or plate-like material. The apparatus comprises a base 1 supporting a feeding unit 2 which delivers successive blanks 21 from a magazine 7 or another suitable source to a transfer station 4 where a freshly delivered blank is held in a predetermined position by resting on a stationary stop 22. The apparatus further comprises conveying means 3 including an endless belt conveyor 23 whose upper reach advances a series of discrete arrays (commodities) 24 along a horizontal or substantially horizontal path extending at right angles to the plane of FIG. 1. The packs 27 which form successive arrays 24 are assembled into such arrays in a conventional manner (not shown) downstream of the outlet of a cigarette packing machine, e.g., a machine which is manufactured and sold by the assignee of the present application. The base 1 further supports a transmission unit 6 which includes means for moving various component parts of the apparatus in synchronism with one another so as to ensure that the conversion of successive arrays 24 and blanks 21 into cartons 74 will be carried out in a predetermined sequence.

Figure 4:
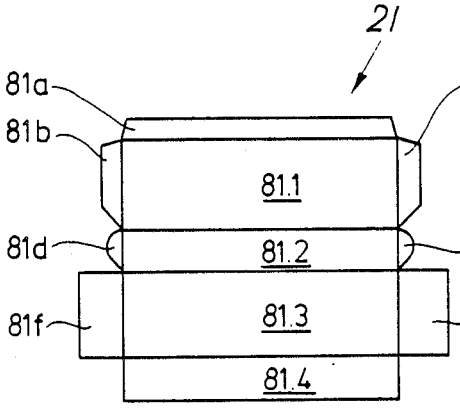
FIG. 4 is a plan view of a blank which is to be converted into the envelope of a carton of the type customary in the United States.

The magazine 7 contains a supply 9 of parallel blanks 21 which are preferably formed with fold lines or weakened portions so as to ensure that their panels and flaps can be folded in a predictable manner, i.e., so that each of the blanks 21 can be converted into an envelope which closely hugs the outline of the respective array 24. The magazine 7 is mounted on a column 8 of the base 1 and its bottom wall slopes so that the supply 9 of blanks 21 therein tends to slide downwardly whereby the foremost blank 21 of the supply 9 abuts against a mobile carrier 16 at a level below one or more suction cups 12 forming part of means for feeding successive blanks 21 to the transfer station 4, i.e., onto the stop 22. The illustrated suction cup 12 is movable back and forth (see the double-headed arrow 11) by a linkage 13 which receives motion from suitable cam means (not specifically shown) of the transmission unit 6. When the suction cup 12 attracts the foremost blank 21 of the supply 9 and is caused to move in a direction to the right, as viewed in FIG. 1, such foremost blank is withdrawn from the magazine 7 and its lower edge portion moves over and beyond the barrier 16 to enter the nip of two advancing rollers 14 which also constitute component parts of the means for feeding successive blanks 21 to the transfer station 4. The rollers 14 advance the freshly withdrawn blank 21 into the nip of two additional advancing rollers 17 which, in turn, advance the blank into the nip of a third pair of rollers 18 serving to advance the blank all the way into or close to abutment with the stop 22 at the transfer station 4. The difference between the levels of the pairs of advancing rollers 17 and 18 is sufficient to allow for the installation of a paster 19 including one or more adhesive discharging nozzles which apply layers of adhesive to selected portions of successive blanks 21 so as to ensure that the overlapping portions of a converted blank will adhere to each other, i.e., to ensure the integrity of a freshly formed carton 74. For example, if each blank 21 is of the type shown in FIG. 4 (such blank is convertible into the envelope of a cigarette carton which is customary in the United States), the paster 19 will apply layers of adhesive to the elongated lateral flap 81*a* as well as to the shorter flaps 81*b*, 81*c*, 81*d*, 81*e*, of each blank. The reference characters 81.1, 81.2, 81.3 and 81.4 denote the four major panels of the blank 21 which is shown in FIG. 4.

A blank 21 whose flaps have been properly coated with layers of adhesive advances beyond the nip of the advancing rollers 18 and descends by gravity onto the stop 22 at the transfer station 4. Such blank 21 is then adjacent to a predetermined portion of the path for the arrays 24 of cigarette packs 27 on the upper reach of the belt conveyor 23.

The foremost array 24 of cigarette packs 27 on the conveyor 23 is adjacent to a channel 26 which leads to the inlet 64 of a mobile hollow deforming member 28 when the latter is held in a first position 31. The member 28 is pivotable about the horizontal axis of a shaft 29 between the first position 31 and a second position 32 whereby the inlet 64 moves along an arcuate path which is located in a vertical plane.

Figure 3:
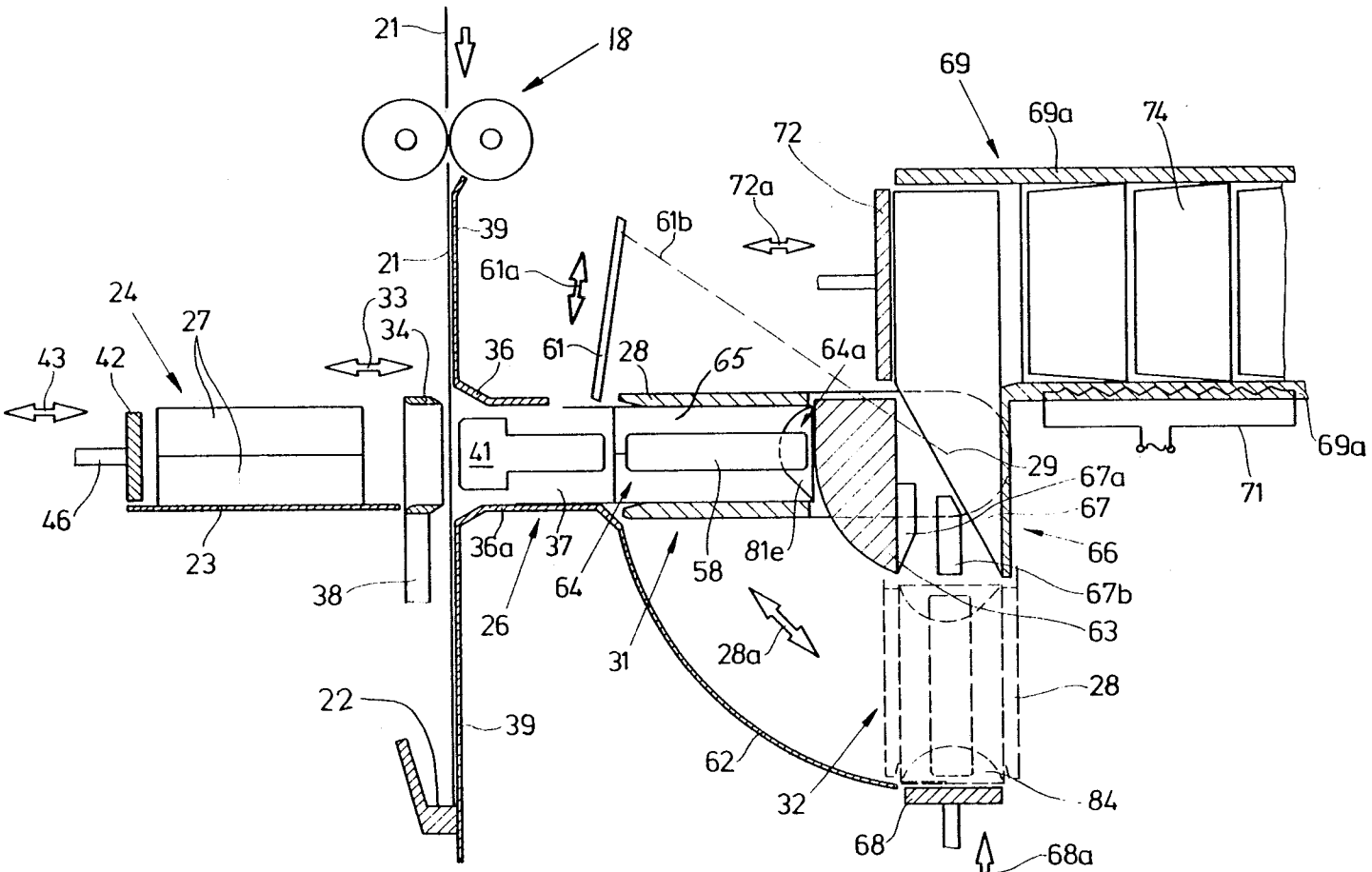
FIG. 3 is an enlarged vertical sectional view of a detail as seen in the direction of arrows from the line III—III in FIG. 2, the second position of the deforming member being shown by broken lines.

The details of the deforming member 28 can be best seen in FIG. 3. This member has an outlet 64*a* which is located opposite the inlet 64 and is also moved along an arcuate path when the deforming member 28 is caused to move between its positions 31 and 32. The axis of the shaft 29 is nearer to the oulet 64*a* than to the inlet 64 and is located outside of the housing 54 of the deforming member 28. The second position 32 of the member 28 is shown in FIG. 3 by broken lines. The chamber 65 which is defined by the housing 54 of the member 28 is aligned with the channel 26 when the member 28 dwells in the first position 31 so that the foremost array 24 of ten cigarette packs 27 can be transferred into the chamber 65 by a reciprocable plunger 42 forming part of the means for transferring successive arrays 24 and the adjacent blanks 21 into the channel 26 and thence into the chamber 65 of the deforming member 28. The plunger 42 is reciprocable in directions which are indicated by a double-headed arrow 43 and cooperates with a mobile mouthpiece 34 mounted on one or more cam-operated levers 38 so as to move back and forth as indicated by the double-headed arrow 33. The channel 26 comprises two stationary sidewalls 36 and 36*a* bounding a passage 37 which leads from the mouthpiece 34 toward the inlet 64 when the deforming member 28 is held in the first position 31. The sidewalls 36 and 36*a* of the channel 26 carry plate-like guide members 39 for successive foremost blanks 21. One of the guide members 39 is mounted between the nip of the advancing rollers 18 and the sidewall 36, and the other guide member 39 extends from the sidewall 36*a* to the stop 22. The latter defines with the adjacent guide member 39 a pocket for the lower marginal portion of the blank 21 which is held in the predetermined position at the transfer station 4.

The channel 26 further comprises two folding elements 41 which extend toward the passage 37 and fold the small flaps 81*d*, 81*e* of the blank 21 which is pushed by the respective array 24 toward the inlet 64 of the deforming member 28.

The plunger 42 of the means for transferring successive arrays 24 into the deforming member 28 is reciprocable by a rod 46 which is moved back and forth (arrow 43) by a carriage 44 reciprocable along one or more horizontal tie rods or rails 47 under the action of a motion transmitting mechanism including a short link 48, a bell crank lever 49 having a longer arm 49*a* coupled to the link 48 and a shorter arm 49*b* provided with a roller follower 51 tracking the face of a cam 52 which is rotated by one gear 53 of the transmission unit 6. The configuration of the face on the cam 52 is selected with a view to ensure that the plunger 42 can perform strokes of requisite length, i.e., that the plunger can transfer successive arrays 24 from the upper reach of the conveyor 23 into the chamber 65 of the deforming member 28 while the latter dwells in the first position 31 in which the inlet 64 is located at the level of the outlet 64*a* and the array 24 is free to advance along a substantially horizontal path in a direction to the right, as viewed in FIGS. 1 or 3.

As can be seen in FIG. 2, the bottom wall of the tubular housing 54 of the deforming member 28 is formed with an elongated slot 56 extending at right angles to the axis of the shaft 29 for the member 28 and serving to receive a portion of a means 68*c* for reciprocating a pusher 68 forming part of the means for expelling successive arrays 24 and the respective (partially deformed) blanks 21 from the chamber 65 into a receiving unit 66 of the improved apparatus. The capacity of the chamber 65 can be caused to conform to the dimensions of arrays 24 by an insert 57 (e.g., a plate) which is installed in the housing 54 (when necessary) to ensure that the introduced arrays 24 are maintained in optimum positions for the draping of the respective blanks 21 therearound. Similar or analogous inserts can be provided for the channel 26 and for the mouthpiece 34 if the apparatus is to be converted from the treatment of a first type of commodities to the treatment of commodities having a different shape.

The housing 54 further contains two parallel plate-like hold-down elements 58 which prevent uncontrolled pivoting of already folded flaps 81*d*, 81*e* while the respective blank 21 dwells in the chamber 65. The shaft 29 which defines the pivot axis for the deforming member 28 is mounted in the frame 59 at one end and in the housing 6*a* of the transmission unit 6 at the other end.

The reference character 61 denotes a folding element which is movable back and forth (see the arrow 61*a*) about the axis of the shaft 29. The means for moving the folding element 61 back and forth includes a linkage denoted in FIG. 3 by a phantom line 61*b* and receiving motion from a cam in the transmission unit 6. The element 61 can be used to fold the flap 81*a* of each blank 21 over the adjacent side of the array 24 in the passage 37 of the channel 26 as soon as the array has entered the chamber 65 of the deforming member 28. The linkage 61*b* thereupon retracts the folding element 61 in good time before the plunger 42 is caused to transfer the next foremost array 24 from the conveyor 23 into the passage 37. It is clear that the folding element 61 need not perform a movement along an arcuate path whose center of curvature is on the axis of the shaft 29; for example, the element 61 can be reciprocated by a fluid-operated motor (not shown) in synchronism with the operation of the plunger 42.

The inlet 64 is automatically blocked during movement along its arcuate path (arrow 28*a*) by a stationary folding device 62 for the flaps 81*a* of successive blanks 21. The folding device 62 has a concave surface facing the deforming member 28 and its dimensions are selected in such a way that the inlet 64 is accessible in the first position 31 as well as in the second position 32 of the member 28. However, the array 24 in the chamber 65 cannot change its position relative to the housing 54 while the deforming member 28 is pivoted from the position 31 toward the position 32. The concave surface of the folding device 62 automatically folds the panel 81.4 over the previously folded flap 81*a* (such flap was folded by the element 61) and biases the folded panel 81.4 against the flap 81*a* to thus ensure that the adhesive layer on the flap 81*a* can set and prevent an opening of the deformed blank 21.

The outlet 64*a* of the deforming member 28 is adjacent to a block-shaped stationary obstruction 63 which is configurated in such a way that it blocks the outlet 64*a* in the first position 31 of the member 28 as well as while the member 28 moves toward its second position 32. The obstruction 63 is ineffective in the second position 32 of the member 28 so that the pusher 68 can be caused to move vertically upwardly (i.e., in a direction at right angles to the direction of movement of an array 24 into the chamber 65) and to expel the array 24 and the respective blank 21 into the receiving unit 66. A convex surface of the obstruction 63 is adjacent to the arcuate path of movement of the outlet 64*a* during pivoting of the member 28 from the second position 32 toward the first position 31, and a substantially flat surface of the obstruction 63 is adjacent to the outlet 64*a* in the first position 31 of the member 28.

The channel 26 and the receiving unit 66 are located in a common vertical plane, and the receiving unit 66 is located at a level above the outlet 64*a* when the deforming member 28 reaches the second position 32. The vertical path which is defined by the receiving unit 66 is normal to the horizontal path which is defined by the channel 26. The receiving unit 66 comprises stationary folding means including two discrete folding elements 67 and 67*a* serving to fold the flaps 81*b*, 81*c*, 81*f*, 81*g* of the blank 21 which is being expelled from the chamber 65. A hold-down device in the form of a rib or web 67*b* in the receiving unit 67 prevents the flaps 81*d*, 81*e* from moving away from the adjacent portions of the array 24 which is in the process of advancing through the receiving unit 66 under the action of the ascending pusher 68.

The reciprocating means 68*c* for the pusher 68 is slidable along several tie rods 70 (see FIGS. 1 and 2) to move the pusher in the directions which are indicated by the double-headed arrow 68*a*. The reciprocating means 68*c* receives motion from a mechanism which is preferably analogous to the parts 48, 49, 51, 52 and receives motion from one gear of the transmission unit 6 in the housing 6*a*.

The receiving unit 66 admits successive arrays 24 and the respective deformed blanks 21 into a transporting unit including a stationary tunnel 69 and a pusher 72 which is reciprocable in directions indicated by the double-headed arrow 72*a*. The path which is defined by the tunnel 69 is parallel to the path which is defined by the channel 26. In order to ensure reliable and rapid setting of adhesive on the flaps of successive deformed blanks 21, at least one of the sidewalls 69*a* of the tunnel 69 is heated, e.g., by an electric resistance heater 71. A similar or a different heater can be installed in the other wall or walls 69*a* of the tunnel 69 and/or in one or more walls of the receiving unit 66. The pusher 72 receives motion from levers 73 and a bell crank lever 73*a* (FIG. 2) which are pivoted by a suitable cam 79 of the transmission unit 6. The levers 73 are rigidly connected to a shaft 77 which is journalled in the frame 59, and one arm of the bell crank lever 73*c* carries a roller follower 78 which tracks the face of the cam 79 to thereby move the pusher 72 back and forth in synchronism with operation of the pusher 68. The cam 79 for the bell crank lever 73*c* is driven by the gear 53*c* of the transmission unit 6. The other arm of the bell crank lever 73*c* is coupled to the shaft 77 by links 73*b* and 73*c* (see the upper portion of FIG. 1).

The levers 73 can be said to constitute one arm of a bell crank lever the other arm of which is constituted by the link 73*c*. This bell crank lever is rigidly mounted on the shaft 77 and its arm 73*c* is coupled to one arm of the bell crank lever 73*a* by the link 73*b*. The latter is omitted in FIG. 2 for the sake of clarity.

Successive cartons 74 which issue from the tunnel 69 can be advanced to a station where predetermined numbers of cartons are assembled into groups for insertion into boxes or the like.

FIG. 2 shows that the reciprocating means 68*c* for the pusher 68 is mounted on a carriage or slide 68*b* which is reciprocable along the tie rods 70 by a link 76 receiving motion from an additional cam of the transmission unit 6. The link 76 is analogous to the link 48 of the mechanism which reciprocates the plunger 42, and the link 76 receives motion from a cam on the gear 53*a* in the housing 6*a* of the transmission unit 6.

The transmission unit 6 comprises the aforementioned gears 53, 53*a*, 53*c* and additional gears 53*b* and 53*d*. The teeth (not shown) of these gears are in mesh to ensure proper synchronization of movements of various mobile components of the improved apparatus. The directions in which the gears 53–53*d* are rotated by the main prime mover (e.g., a variable-speed electric motor) of the apparatus are indicated by arrows. FIG. 1 shows a portion of the aforementioned cam 52 for the plunger 42, and FIG. 2 shows a portion of the aforementioned cam 79 for the pusher 72. Each of the gears 53, 53*a*, 53*b*, 53*d* carries a pair of cams. The gear 53 transmits motion to the cam 52 and to a cam which transmits motion to the barrier 16 at the discharge end of the magazine 7. The cams on the gear 53*a* transmit motion to the lever or levers 38 for the mouthpiece 34 and to the pusher 68, i.e., to the link 76. The cams on the gear 53*b* serve to pivot the deforming member 28 about the axis of the shaft 29 and to move the folding element 61. As mentioned above, the cam 79 on the gear 53*c* transmits motion to the pusher 72. The cams on the gear 53*d* transmit motion to the linkage 13 for the suction cup 12. The means for moving the mobile components of the improved apparatus can be modified in a number of ways without departing from the spirit of the invention. For example, fluid-operated motors and/or electromagnets can be used in lieu of some or all of the cam and follower assemblies.

Figure 5:
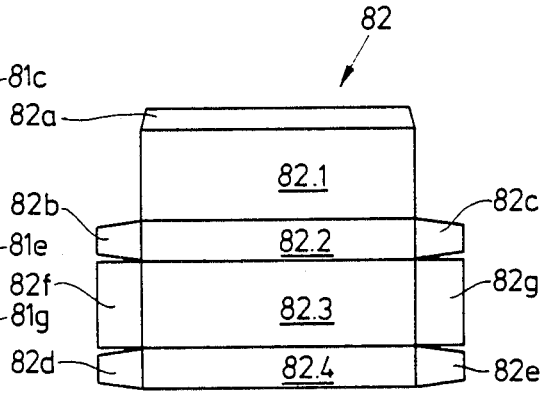
FIG. 5 is a similar plan view of a blank which is convertible into the envelope of a modified carton of the type normally sold in European countries.

FIG. 5 shows a modified blank 82 which is preferred in numerous European countries and includes four panels 82.1, 82.2, 82.3, 82.4, an elongated flap 82*a* on the panel 82.1, two small flaps 82*b*, 82*c* at the ends of the panel 82.2, two larger flaps 82*f*, 82*g* at the ends of the panel 82.3, and two small flaps 82*d*, 82*e* at the ends of the panel 82.4.

The mode of operation of the improved apparatus for the making of cartons 74 which utilize blanks 21 of the type shown in FIG. 4 is as follows:

The suction cup 12 is caused to withdraw the foremost blank 21 of the supply 9 in the magazine 7 and to insert the lower marginal portion of the withdrawn blank 21 into the nip of the advancing rollers 14. The blank 21 is thereupon advanced by the rollers 17, 18 and is partially coated with adhesive paste at 19 prior to reaching the stop 22 at the transfer station 4.

In the next step, the lever or levers 38 move the mouthpiece 34 in a direction to the right, as viewed in FIGS. 1 or 3, in order to introduce a portion of or the entire mouthpiece 34 into the channel 26. This entails some folding of the blank 21 which rests on the stop 22, namely a folding along the line between the panels 81.1 and 81.2 as well as along the fold line between the panels 81.2 and 81.3. The plunger 42 is thereupon moved in a direction to the right, as viewed in FIG. 3, to push an array 24 of ten cigarette packs 27 through the mouthpiece 34, through the channel 26 and into the chamber 65 of the deforming member 28 by way of the inlet 64 (the member 28 is then held in the first position 31). The feature that the mouthpiece 34 moves the panels 81.1, 81.2, 81.3 relative to each other before the respective blank 21 is contacted by the adjacent array 24 is desirable and advantageous because this reduces the likelihood of deformation of edge portions of the array 24 during transfer into the chamber 65. Deformation of the blank 21 progresses as the respective array 24 penetrates into the passage 37 of the channel 26 so that the blank is converted into a substantially U-shaped body which is closely adjacent to the respective sides of the array. The folding elements 41 engage and fold the small flaps **81*d*, 81*e* during travel of the blank 21 through the passage 37 of the channel 26. The front side of the array 24 which is being pushed into the channel 65 abuts against the panel 81.2 of the partially deformed blank 21. The panel 81.1 is located on top of the advancing array 24 and the panel 81.3 is disposed below the array. The folding element 61 is caused to move downwardly and to fold the long flap 81*a* as soon as the respective array 24 enters the chamber 65. The folding device 62 folds the panel 81.4 over the exposed side of the flap 81*a* and thus completes the conversion of the blank 21** into a tube.

When the deforming member 32 reaches the second position 32, the pusher 68 is caused to move upwardly and to expel the array 24 as well as the respective blank 21 into the receiving unit 66 whereby the stationary folding elements 67 and **67*a* fold the flaps 81*b*, 81*c* and thereupon the flaps 81*f*, 81*g* to complete the conversion of the blank 21 into a parallelepiped envelope which surrounds all sides of the respective array 24 not later than when the thus obtained carton 74 moves in front of the (then retracted) pusher 72. The latter is caused to perform a forward stroke (in a direction to the right, as viewed in FIG. 1) and to advance the carton 74 into the tunnel 69 wherein the flaps of the envelope of such carton are heated by the heating means 71** to ensure rapid setting of the adhesive.

The deforming member 28 can be pivoted from the second position 32 to the first position 31 even before the pusher 68 is returned to its retracted (lower end) position. This is possible because the reciprocating means **68*c* extends through the slot 56 in the housing 54 of the member 28**. Such mode of operation contributes significantly to a higher output of the improved apparatus.

If the apparatus is to process blanks 82 of the type shown in FIG. 5, the pusher 68 is replaced with or converted into a pusher which is provided with folding elements 84 (indicated in FIG. 3 by broken lines) for those portions of the partially deformed blank 82 which project from the inlet 64 of the deforming member 28 when the latter reaches its second position 32. The projecting portions include the flaps **82*d* and 82*e* which are folded by the folding elements 84 before the folding elements 67, 67*a* fold the flaps 82*f* and 82*g***.

The improved apparatus exhibits the advantage that it can complete the conversion of a blank 21 into the envelope of a carton 74 in a small area. This is due to the fact that the direction of advancement of inserted arrays 24 need not be changed in order to expel such arrays from the chamber 65 of the deforming member 28. Thus, the pusher 42 introduces successive arrays by moving them through the inlet 64 and toward the outlet **64*a* of the deforming member 28, and the pusher 68 thereupon simply resumes the advancement of each inserted array 24 in the same direction, namely through and beyond the outlet 64*a* and into the receiving unit 66. Such mode of advancing successive arrays 24 into and from the deforming member 28 further contributes to simplicity and lower cost of the improved apparatus. The feature that the channel 26 and the receiving unit 66 are located in a common vertical plane and that the deforming member 28 is pivotable through approximately or exactly 90 degrees about a horizontal axis also contributes to simplicity and compactness of the apparatus, the same as the feature that the path which is defined by the channel 26 is substantially horizontal whereas the path which is defined by the receiving means 66** is substantially vertical.

The folding device 62 performs the function of a means for preventing any shifting of inserted arrays 24 and blanks 21 relative to the deforming member 28 while the latter is in the process of moving from the position 31 to the position 32 as well as of automatically folding that portion (panel 81.4) of a blank 21 which projects from the chamber 65 (i.e., beyond the inlet 64) while the blank 21 shares the pivotal movement of the deforming member 28 from the position 31 to the position 32.

As mentioned before, the provision of the slot 56 in the bottom wall of the housing 54 and the feature that the reciprocating means **68*c* for the pusher 68 can extend through such slot while the pusher 68 is held in the extended position render it possible to return the deforming member 28 to the first position 31 before the pusher 68** reassumes its retracted position. This contributes to a higher output of the apparatus.

The purpose of the obstruction 63 is to ensure that the inserted array 24 and the respective blank 21 are held in optimum positions for engagement of the panel 81.4 by the folding device 61 as well as that the panel 81.4 invariably extends from the inlet 64 and is ready to be folded by the device 62 as soon as the member 28 begins to leave the position 31.

The aforediscussed orientation of the tunnel 69 and receiving means 66 (so that the path which is defined by the receiving unit 66 is normal to the path which is defined by the channel 26 and that the path which is defined by the channel 26 is parallel to the path which is defined by the tunnel 69) also contributes to compactness of the apparatus and renders it possible to gain access to all parts at or in the region of the transfer station 4. The placing of folding elements 67 and **67*a* into the receiving unit 66 ensures that the conversion of successive blanks 21 into envelopes is completed not later than when such blanks advance in front of the pusher 72**.

Another important advantage of the improved apparatus is its pronounced versatility. Thus, the apparatus can process differently dimensioned arrays by the simple expedient of changing the effective volume of the chamber 65, of the passage 37 and of the space within the mouthpiece 34 and by providing the pusher 68 with the folding elements 84. The application of adhesive takes place before the blanks 21 or 82 reach the transfer station 4 and is carried out in a space which is readily accessible to the attendants. Moreover, the flaps of each blank 21 or 82 are properly bonded to each other and/or to the panels of the respective blanks independently of the preceding or next-following blanks. This contributes to a substantial reduction of the number of rejects because the adhesive-coated portions of the blanks are properly bonded to the adjacent portions of the respective envelopes irrespective of the regularity or lack of regularity of delivery of arrays 24 and/or blanks 21 or 82 to the transfer station 4, as long as each blank which comes to rest on the stop 22 is engaged by and transported with an array 24. Still further, the directions in which the blanks 21 or 82 are transported in the improved apparatus are selected in such a way that the blanks are not transported in directions which would cause or facilitate opening of the already folded flaps.

Numerous features of the improved apparatus are believed to be worthy of independent patent protection. This applies, for example, for the construction and mounting of the deforming member 28, for the orientation of the channel 26 and receiving unit 66 relative to each other and relative to the deforming member 28, for the provision of the slot 56 and its ability to allow for practically immediate return movement of the deforming member 28 from the second position 32 to the first position 31, for the provision of the obstruction 63, for the provision of the carton transporting means 69, 72, for the feature that the blanks 21 or 82 can be heated in the receiving unit 64 and/or in the tunnel 69 of the transporting unit, and for the provision of one or more folding elements 84 on the pusher 68.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for wrapping foldable blanks around successive commodities, particularly for wrapping successive arrays of cigarette packs into blanks which are converted into cartons, comprising means for conveying successive commodities along a predetermined path; a hollow deforming member having an inlet and an outlet opposite said inlet; means for moving said deforming member about a predetermined axis between first and second positions in which said inlet is respectively adjacent to and remote from a portion of said path, the orientation of said inlet and said outlet in the first position being different from the orientation of said inlet and said outlet in the second position of said member; a source of blanks; means for feeding successive blanks from said source to a predetermined position between a commodity in said portion of said path and said inlet in the first position of said member; means for transferring successive commodities from said portion of said path into said member by way of said inlet in the first position of said member with attendant partial draping of the blank, which was held in said predetermined position, around the transferred commodity; and means for expelling successive commodities and the respective blanks from said member by way of said outlet in the second position of said member, including a pusher arranged to enter said member by way of said inlet, said transferring and said expelling means being movable along paths which cross said axis.

2. The apparatus of claim 1, wherein said moving means comprises means for pivoting said deforming member about said predetermined axis.

3. The apparatus of claim 1, further comprising means for closing said outlet in the first position of said deforming member.

4. The apparatus of claim 3, wherein said axis is nearer to said outlet than to said inlet and is spaced apart from said member so that said inlet and said outlet move along discrete arcuate paths during pivoting of said member between said first and second positions, said closing means including a stationary obstruction adjacent to that portion of the arcuate path for said outlet which is occupied by said outlet at least in the first position but not in the second position of said member.

5. The apparatus of claim 1, further comprising means for receiving successive commodities and the respective blanks from said member by way of said outlet in successive second positions of said member, the blanks which issue from said member having portions which project from the respective commodities and said receiving means having means for folding such projecting portions of the blanks during expulsion of the respective commodities from said member.

6. The apparatus of claim 5, wherein said folding means comprises at least one stationary folding element.

7. The apparatus of claim 1, wherein said transferring means includes means for advancing successive commodities along a substantially horizontal path.

8. The apparatus of claim 1, further comprising means for receiving successive commodities and the respective blanks from said member in successive second positions of said member, and further comprising means for transporting successive commodities and the respective blanks away from said receiving means.

9. The apparatus of claim 8, further comprising means for heating selected portions of successive blanks in at least one of said receiving and transporting means.

10. The apparatus of claim 1, wherein said moving means includes means for pivoting said member so as to move said inlet along an arcuate path, the blanks which are partially draped around the respective commodities as a result of the transfer of such commodities into said deforming member having portions projecting from said inlet and further comprising means for folding the projecting portions of such blanks during movement of said inlet along said arcuate path.

11. The apparatus of claim 10, wherein said folding means includes a stationary folding device which is adjacent to said arcuate path.

12. The apparatus of claim 10, wherein said folding means includes means for blocking said inlet during movement of said member between said first and second positions.

13. The apparatus of claim 1, wherein the blanks in said member include portions which project from the respective commodities and said pusher comprises means for folding such projecting portions of the blanks as a result of movement of the pusher relative to said member.

14. Apparatus for wrapping foldable blanks around successive commodities, particularly for wrapping successive arrays of cigarette packs into blanks which are converted into cartons, comprising means for conveying successive commodities along a predetermined path; a hollow deforming member having an inlet and an outlet opposite said inlet; means for moving said deforming member about a predetermined axis between first and second positions in which said inlet is respectively adjacent to and remote from a portion of said path; a source of blanks; means for feeding successive blanks from said source to a predetermined position between a commodity in said portion of said path and said inlet in the first position of said member; means for transferring successive commodities from said portion of said path into said member by way of said inlet in the first position of said member with attendant partial draping of the blank, which was held in said predetermined position, around the transferred commodity, said transferring means including means for advancing successive commodities in a first direction; and means for expelling successive commodities and the respective blanks from said member by way of said outlet in the second position of said member, including a pusher arranged to enter said member by way of said inlet and to advance successive commodities in a second direction transversely of said first direction, said transferring and said expelling means being movable along paths which cross said axis.

15. The apparatus of claim 14, further comprising means for receiving successive commodities which are expelled from said member by way of said outlet in the second position of said member.

16. The apparatus of claim 15, wherein said moving means includes means for pivoting said deforming member about a predetermined axis so that said inlet moves along a second path which is located in a substantially vertical plane.

17. The apparatus of claim 15, wherein said moving means comprises means for pivoting said member about a substantially horizontal axis.

18. Apparatus for wrapping foldable blanks around successive commodities, particularly for wrapping successive arrays of cigarette packs into blanks which are converted into cartons, comprising means for conveying successive commodities along a predetermined path; a hollow deforming member having an inlet and an outlet opposite said inlet; means for moving said deforming member between first and second positions in which said inlet is respectively adjacent to and remote from a portion of said path, said inlet being located substantially at the level of said outlet in the first position of said member and said inlet being located at a level below said outlet in the second position of said member, said moving means including means for pivoting said member back and forth through substantially 90 degrees and about a substantially horizontal axis; a source of blanks; means for feeding successive blanks from said source to a predetermined position between a commodity in said portion of said path and said inlet in the first position of said member; means for transferring successive commodities from said portion of said path into said member by way of said inlet in the first position of said member with attendant partial draping of the blank, which was held in said predetermined position, around the transferred commodity, said transferring means including means for advancing successive commodities along a substantially horizontal second path; and means for expelling successive commodities and the respective blanks from said member by way of said outlet in the second position of said member, including a pusher arranged to enter said meber by way of said inlet.

19. The apparatus of claim 18 wherein said pusher is arranged to advance successive commodities substantially vertically upwardly in successive second positions of said member.

20. Apparatus for wrapping foldable blanks around successive commodities, particularly for wrapping successive arrays of cigarette packs into blanks which are converted into cartons, comprising means for conveying successive commodities along a predetermined path; a hollow deforming member having an inlet an outlet opposite said inlet; means for moving said deforming member between first and second positions in which said inlet is respectively adjacent to and remote from a portion of said path, said moving means including means for pivoting said member between said first and second positions about a predetermined axis and said deforming member including a housing defining a chamber which communicates with said inlet and said outlet, said housing having a slot extending transversely of said axis; a source of blanks; means for feeding successive blanks from said source to a predetermined position between a commodity in said portion of said path and said inlet in the first position of said member; means for transferring successive commodities from said portion of said path into said member by way of said inlet in the first position of said member with attendant partial draping of the blank, which was held in said predetermined position, around the transferred commodity; and means for expelling successive commodities and the respective blanks from said member by way of said outlet in the second position of said member, including a pusher arranged to enter said member by way of said inlet and means for reciprocating said pusher between an extended position in which the pusher is located in said chamber in the region of said outlet and a retracted position outside of said housing, said reciprocating means extending through said slot in the second position of said member while said pusher is located in said chamber regardless of the angular position of said member so that said pusher can dwell in said extended position while said member pivots from said second toward said first position.

* * * * *